United States Patent [19]

Franz

[11] 4,007,688

[45] Feb. 15, 1977

[54] TIMED MISSILE FLIGHT TERMINATION SYSTEM

[75] Inventor: David Bruce Franz, Ventura, Calif.

[73] Assignee: The United States of America as represented by the Secretary of the Navy, Washington, D.C.

[22] Filed: Feb. 23, 1976

[21] Appl. No.: 660,604

[52] U.S. Cl. ..... 102/49.5; 102/49.6

[51] Int. Cl.[2] ..... F42C 9/10

[58] Field of Search ..... 102/49.5, 49.6, 85, 102/81, 81.6

[56] References Cited

UNITED STATES PATENTS

| | | | |
|---|---|---|---|
| 2,145,507 | 1/1939 | Denoix | 102/49.6 |
| 2,704,033 | 3/1955 | Koeper et al. | 102/49.6 |
| 2,937,595 | 5/1960 | Margulis et al. | 102/49.5 |
| 3,135,204 | 6/1964 | Menichelli et al. | 102/49.5 |
| 3,185,090 | 5/1965 | Weber | 102/49.5 |
| 3,331,324 | 7/1967 | Oss et al. | 102/49.5 |
| 3,343,489 | 9/1967 | Whitehouse | 102/49.6 |

FOREIGN PATENTS OR APPLICATIONS

| | | | |
|---|---|---|---|
| 1,291,668 | 3/1962 | France | 102/49.5 |
| 1,428,656 | 2/1969 | Germany | 102/49.5 |

*Primary Examiner*—Verlin R. Pendegrass
*Attorney, Agent, or Firm*—Richard S. Sciascia; Joseph M. St.Amand; William W. Cochran, II

[57] ABSTRACT

A pressure activated, timed missile flight termination system for destroying a test missile after a predetermined period of flight to shorten its hazard space so that it can be used on firing ranges having a minimum amount of area. A delayed destruct sequence is initiated by pressure in the missile combustion chamber upon ignition of the missile. A pressure driven piston is compressed by the pressure created in the combustion chamber, causing it to strike a primer which initiates a delay fuse, a detonator, and a linear-shaped charge to destroy the missile.

9 Claims, 2 Drawing Figures

TIMED MISSILE FLIGHT TERMINATION SYSTEM

BACKGROUND OF THE INVENTION

The present invention pertains generally to missile destruction systems and more specifically to a pressure activated, timed flight termination system. The destruction of missiles is considered an essential functional characteristic in their operation. It is particularly important that the ability to destruct a missile be incorporated in an extremely reliable system within the missile so that if a target being fired at is missed, other objects beyond the target, and on the ground below, will not be endangered. This is, of course, most particularly true of missiles having percussion or impact fuses since after arming such missiles will not explode until some object is struck. In attacks on enemy aircraft over friendly territory, the absence of self-destruction means could cause great damage to friendly personnel and property.

In view of the obvious necessity for such devices, there have been numerous types of self-destruction devices developed in the past. In general, the self-destruction function has been implemented by the utilization of dual clock-work systems or by the inclusion of radio-controlled command destruction systems which can be controlled from either an aircraft or a ground station. Dual clock-work systems are subject to the disadvantages of complexity of structure with consequent relatively high cost. In addition, many missiles have limited weight and space requirements for a receiver, power supply, and other structure required by radio-controlled command destruct systems, resulting in the testing and use of these missiles without a flight termination system. For these missiles, the hazard space must be determined by the maximum possible distance of missile flight. Consequently, whenever one of these missiles is fired, a range must be cleared as large or larger than the missile's hazard space. Therefore, a system is needed which is simple in operation, can be implemented within the missile's system at a relatively low cost, and occupies a relatively small area within the confined space limitations of the missile.

SUMMARY OF THE INVENTION

The present invention overcomes the disadvantages and limitations of the prior art by providing a pressure activated, timed missile flight termination system. The system is activated by pressure created within the combustion chamber of the missile to activate a time delay fuse. The fuse is therefore activated instantaneously with the ignition of the missile. The delay fuse provides a predetermined period before the designation of a linear-shaped charge to terminate the flight of the missile.

It is therefore an object of the present invention to provide an improved pressure activated, timed missile flight termination system.

It is also an object of the present invention to provide a pressure activated, timed missile flight termination system which is reliable in operation.

Another object of the present invention is to provide a timed missile flight termination system which can be easily incorporated within the limited confines of a missile.

Another object of the present invention is to provide a timed missile flight termination system which is simple in operation and inexpensive in implementation.

Other objects and further scope of applicability of the present invention will become apparent from the detailed description given hereinafter. The detailed description indicating the preferred embodiment of the invention is given only by way of illustration since various changes and modifications within the spirit and scope of the invention will become apparent to those skilled in the art from the detailed description. The foregoing abstract of the disclosure is for the purpose of providing a non-legal brief statement to serve as a searching, scanning tool for scientists, engineers and researchers and is not intended to limit the scope of the invention as disclosed herein, nor is it intended to be used in interpreting or in any way limiting the scope or fair meaning of the appended claims.

DETAILED DESCRIPTION OF THE PREFERRED EMBODIMENT

Figure 1:
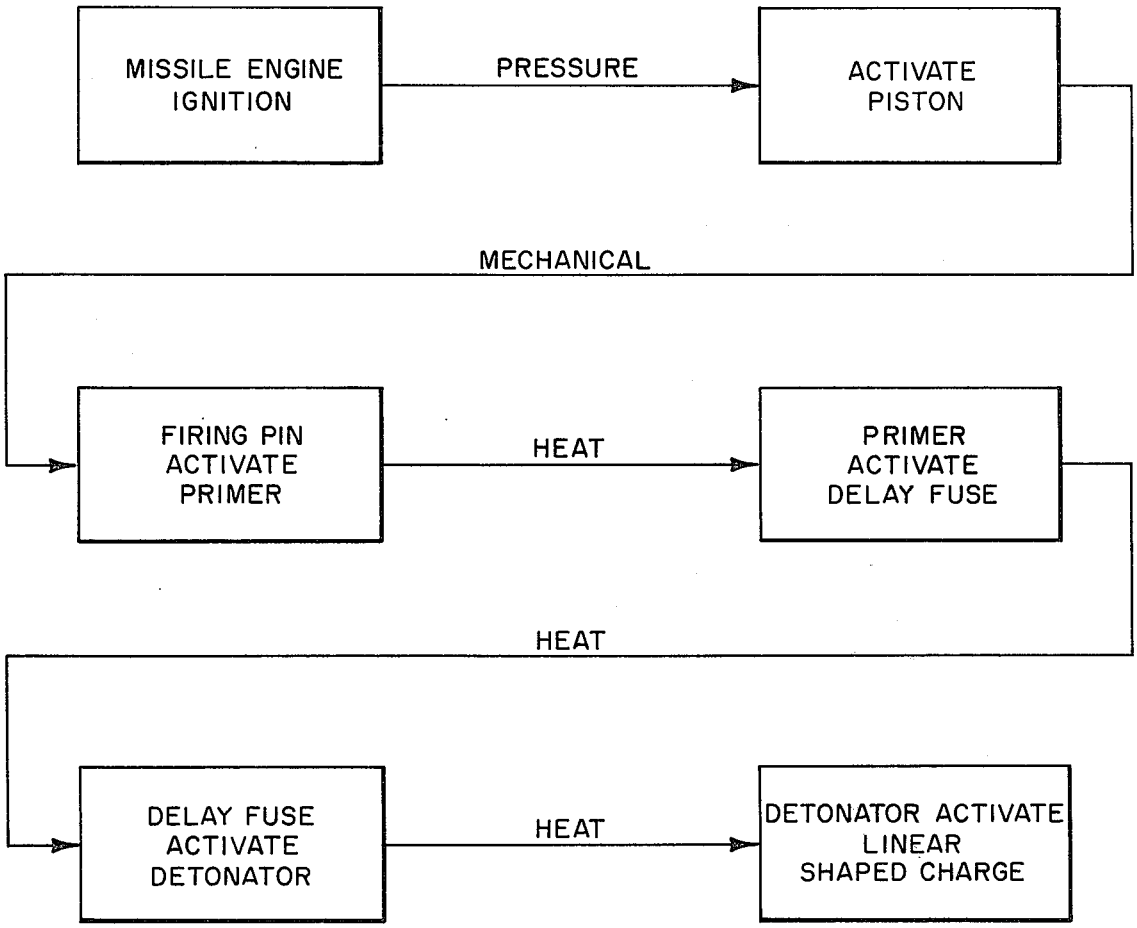
FIG. 1 is a flow diagram of the operation of the preferred embodiment.

FIG. 1 illustrates in a flow diagram the manner of operation of the preferred embodiment of the invention. As disclosed therein, the missile engine ignition activates a piston by the application of pressure within the combustion chamber of the missile. The activated piston causes a firing pin located on the piston to activate a primer by a mechanical movement of the piston. Heat generated by the primer activates a delay fuse which is constructed to provide a predetermined delay period. The delay fuse, in turn, activates a detonator which causes a linear-shaped charge wrapped about the missile to destruct the missile and terminate its flight.

Figure 2:
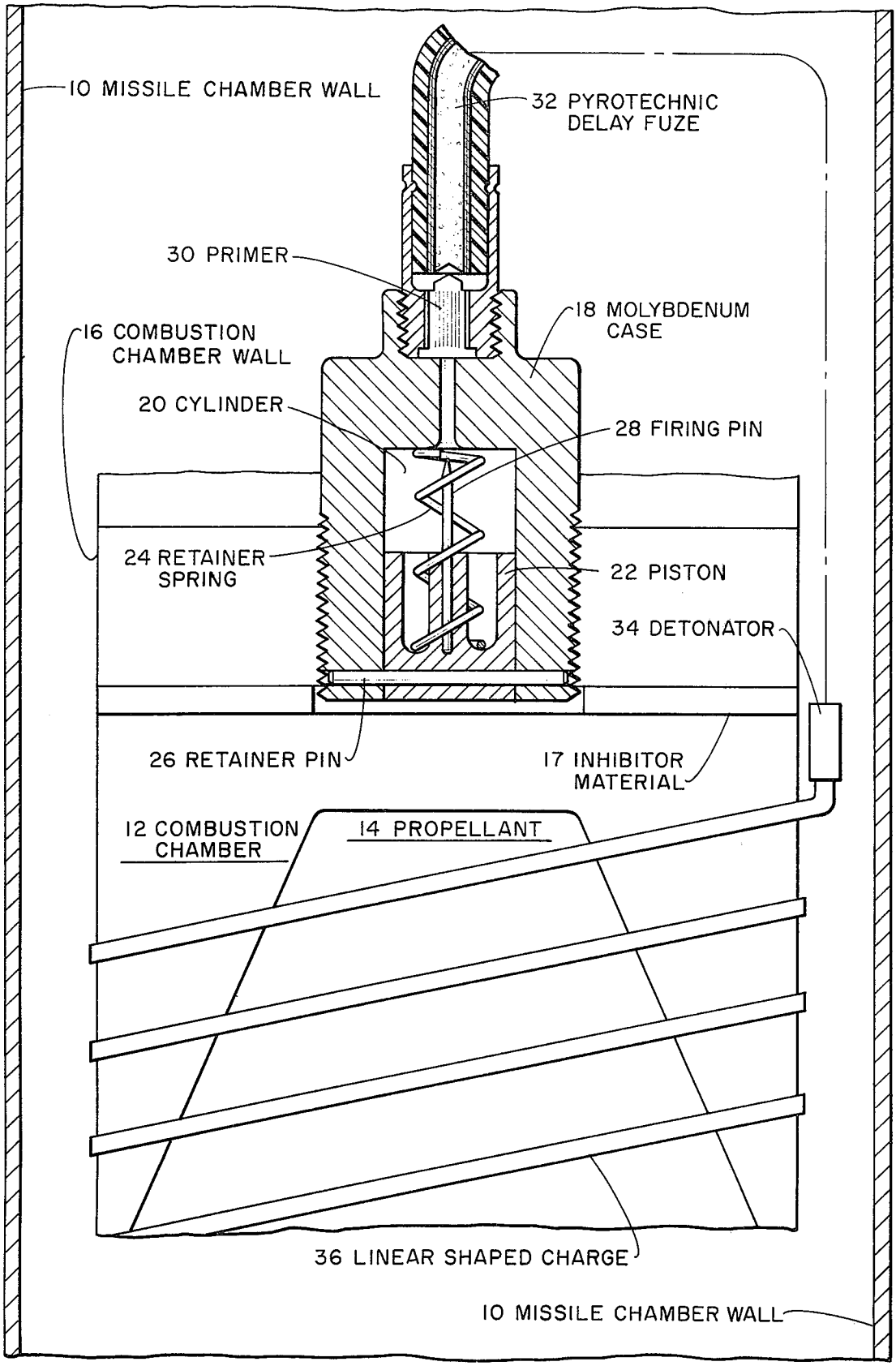
FIG. 2 is a detailed schematic drawing of the preferred embodiment.

Turning to FIG. 2, a more detailed illustration is given of the structure of the preferred embodiment of the invention. As disclosed therein, a combustion chamber 12 is located within the confines of the missile chamber walls 10. Within the combustion chamber 12, the missile propellant 14 is stored and caused to burn upon ignition of the missile. A threaded casing 18, constructed of molybdenum, is secured to a section of the combustion chamber walls 16. Located on the lower portion of the combustion chamber walls 16 is an inhibitor material 17 which cuts down on the transfer of heat to the remaining parts of the missile. A cylinder 20 is formed within the threaded casing 18 in which a piston 22 is disposed in a closely fitting, air-tight seal. A retaining spring 24 is used to force the piston away from the end of the cylinder 18. A retaining pin 26 is inserted through a hole in the threaded casing such that the piston is retained within the chamber. The retaining pin 26 can only be removed upon removal of the threaded casing from the combustion chamber wall. A primer 30 in pyrotechnic delay fuse 32 is threaded into one end of the threaded casing 18. The pyrotechnic delay fuse 32 is connected to a detonator 34, which is in turn connected to a linear-shaped charge 36 wrapped about the combustion chamber of the missile.

In operation, when the propellant 14 is ignited within the combustion chamber to propel the missile, a fairly high pressure is created within the combustion chamber 12. This causes the piston 22 to be forced in an upward manner, as shown in FIG. 2, against the tension of the retainer spring 24. This causes the firing pin 28, secured to the piston 22, to be mechanically propelled into the primer 30, consequently causing the primer to ignite. The ignition of the primer, in turn, activates the pyrotechnic delay fuse 32 which, after a predetermined time period, burns to the detonator 34 causing it to ignite. The detonator 34 is connected to the linear-shaped charge 36 which is wrapped about the combustion chamber of the missile and causes the linear-shaped charge to ignite. The linear-shaped charge, comprising a metal sheeting surrounding a linear explosive charge, has a V-shaped recess adjacent the surface of the combustion chamber. The charge acts to cut the casing of the combustion chamber cleanly in a radial plane so that the missile is shredded into sections, thereby terminating its flight.

The system therefore provides a reliable system for terminating the flight of a missile after a predetermined period. It is reliable in operation, simple in construction and can be incorporated within the most confined limitations of a missile system at a minimal cost.

Obviously many modifications and variations of the present invention are possible in light of the above teachings. It is therefore to be understood that within the scope of the appended claims the invention may be practiced otherwise than as specifically described.

What is claimed is:

1. A pressure activated, timed missile flight termination system comprising:

a. threaded casing means for insertion in a combustion chamber wall of said missile;

b. a cylindrical piston disposed within a cylinder formed in said threaded casing means;

c. a primer detachably connected to said threaded casing means;

d. pin means connected to said cylindrical piston for penetrating said primer and causing said primer to ignite whenever said cylindrical piston is compressed due to a pressure buildup in said combustion chamber;

e. a pyrotechnic delay fuse connected to said primer;

f. detonation means connected to said primer for causing a detonation when ignited by said delay fuse;

g. linear-shaped charge means wrapped around said missile for severing said missile into a plurality of pieces in response to said detonation of said detonation means;

wherein said pressure buildup in said combustion chamber occurs instantaneously upon ignition of said missile and said pyrotechnic delay fuse provides a predetermined delay before ignition of said detonation means so that said missile is automatically destroyed after a predetermined flight period.

2. The timed missile flight termination system of claim 1 wherein said threaded casing means is formed of molybdenum to withstand high pressures and temperatures while maintaining a capability to be milled.

3. The timed missile flight termination system of claim 1 further comprising retaining spring means for preventing said cylindrical piston from being compressed until said pressure buildup in said combustion chamber occurs due to ignition of said missile.

4. The timed missile flight termination system of claim 1 further comprising retaining pin means mounted in said threaded casing means for maintaining said cylindrical piston within said cylinder.

5. The timed missile flight termination system of claim 1 wherein said pyrotechnic delay fuse comprises a lead spitter delay fuse.

6. The timed missile flight termination system of claim 2 further comprising retaining spring means for preventing said cylindrical piston from being compressed until said pressure buildup in said combustion chamber occurs due to ignition of said missile.

7. The timed missile flight termination system of claim 3 further comprising retaining pin means mounted in said threaded casing means for maintaining said cylindrical piston within said cylinder.

8. The timed missile flight termination system of claim 6 further comprising retaining pin means mounted in said threaded casing means for maintaining said cylindrical piston within said cylinder.

9. The timed missile flight termination system of claim 6 wherein said pyrotechnic delay fuse comprises a lead spitter delay fuse.

* * * * *